US007321338B2

(12) United States Patent
Komatsu et al.

(10) Patent No.: US 7,321,338 B2
(45) Date of Patent: Jan. 22, 2008

(54) ON-BOARD ANTENNA

(75) Inventors: Satoru Komatsu, Saitama (JP); Hiroshi Kuribayashi, Saitama (JP); Tomoyuki Fukumaru, Saitama (JP); Hiroshi Iijima, Osaka (JP); Hideaki Oshima, Osaka (JP); Tatsuo Matsushita, Ibaraki (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/743,408

(22) Filed: Dec. 23, 2003

(65) Prior Publication Data

US 2004/0169605 A1 Sep. 2, 2004

(30) Foreign Application Priority Data

Dec. 27, 2002 (JP) ..... P2002-379994

(51) Int. Cl.
*H01Q 1/48* (2006.01)
*H01Q 1/38* (2006.01)
*H01Q 1/32* (2006.01)

(52) U.S. Cl. ..... 343/846; 343/700 MS; 343/711

(58) Field of Classification Search ..... 343/828, 343/700 MS, 769, 846, 850, 711, 713, 767, 343/712, 714–718
See application file for complete search history.

(56) References Cited

U.S. PATENT DOCUMENTS

| | | | | |
|---|---|---|---|---|
| 3,921,177 | A * | 11/1975 | Munson | 343/846 |
| 4,987,421 | A * | 1/1991 | Sunahara et al. | 343/700 MS |
| 5,124,714 | A * | 6/1992 | Harada | 343/713 |
| 5,355,144 | A * | 10/1994 | Walton et al. | 343/713 |
| 5,410,322 | A * | 4/1995 | Sonoda | 343/700 MS |
| 5,510,803 | A * | 4/1996 | Ishizaka et al. | 343/700 MS |
| 5,519,565 | A * | 5/1996 | Kalt et al. | 361/280 |
| 5,594,455 | A * | 1/1997 | Hori et al. | 343/700 MS |
| 6,057,814 | A * | 5/2000 | Kalt | 345/58 |
| 6,097,345 | A | 8/2000 | Walton | 343/769 |
| 6,124,829 | A * | 9/2000 | Iwasaki | 343/700 MS |
| 6,542,131 | B1 | 4/2003 | Haapanen | |
| 6,556,168 | B1 * | 4/2003 | Marumoto et al. | 342/372 |
| 6,906,677 | B2 * | 6/2005 | Yamamoto et al. | 343/789 |
| 2002/0149520 | A1 * | 10/2002 | Laubner et al. | 343/700 MS |
| 2003/0011522 | A1 * | 1/2003 | McKinzie et al. | 343/700 MS |

FOREIGN PATENT DOCUMENTS

| | | |
|---|---|---|
| GB | 2 290 417 A | 12/1995 |
| JP | 40-1681 | 1/1940 |
| JP | 09-246852 | 9/1997 |
| JP | 11-312922 | 11/1999 |
| JP | 2000-223943 | 8/2000 |
| JP | 2000-307339 | 11/2000 |
| JP | 2001-144532 | 5/2001 |
| JP | 2001-284937 | 10/2001 |
| JP | 2002-185243 | 6/2002 |
| JP | 2002-252520 | 9/2002 |
| WO | WO 00/70708 | 11/2000 |

* cited by examiner

*Primary Examiner*—Shih-Chao Chen
*Assistant Examiner*—Minh Dieu
(74) *Attorney, Agent, or Firm*—Arent Fox LLP

(57) ABSTRACT

An on-board antenna includes a radiation element provided on a dielectric substrate, a grounding conductor surrounding a periphery of an outer edge portion of the radiation element at a position spaced away outwardly from the outer edge portion, and a conductive member provided on the surface at a position spaced away outwardly from an outer edge portion of the grounding conductor.

8 Claims, 3 Drawing Sheets

ON-BOARD ANTENNA

BACKGROUND OF THE INVENTION

1. Field of the Invention

The present invention relates to an on-board antenna.

2. Description of the Related Art

Conventionally, a planar antenna is known which comprises a radiation element provided on the same surface of, for example, an automotive window glass which is located on a passenger compartment side thereof and a substantially annular grounding conductor which surrounds the periphery of an outer edge portion of the radiation element at a position spaced away outwardly from the outer edge portion of the radiation element (for example, refer to Japanese Published Patent Application JP-A-2002-252520.

Incidentally, in installing the planer antenna according to the aforesaid conventional example on a vehicle, in the event that the planner antenna is installed on an automotive window glass such as a front windshield or rear window glass, for example, it is desired to prevent the antenna not only from interrupting the vision of occupants but also from deteriorating the external appearance of the vehicle.

However, in the event that the dimensions and layout of the planar antenna are regulated based on the external appearance of the vehicle, for example, there may be caused a risk that attaining desired transmitting and receiving properties is made difficult.

In addition, for example, in a case where a plurality of planar antennas having target frequency bands which are different from each other are installed on the vehicle, in the event that an interference action between the antennas becomes excessively large, there is caused a problem that obtaining desired transmitting and receiving properties becomes difficult.

SUMMARY OF THE INVENTION

The present invention was made in view of the situations, and an object thereof is to provide an on-board antenna which can improve the transmitting and receiving properties thereof while suppressing the deterioration in vehicle installation properties thereof and which can reduce the interference action occurring between a plurality of antennas even in a case where the plurality of antennas are installed on the vehicle.

With a view to solving the problem so as to attain the object, according to a first aspect of the present invention, there is provided an on-board antenna comprising a radiation element (for example, a radiation conductor 21 in an embodiment) provided on the same surface (for example, a passenger compartment-side inner surface 2A in the embodiment) of a dielectric substrate (for example, a rear window glass 2 in the embodiment) and a grounding conductor which surrounds a periphery of an outer edge portion of the radiation element at a position spaced away outwardly from the outer edge portion, characterized in that a conductive member (for example, a linear conductor 12 in the embodiment) is provided on the surface at a position spaced away outwardly from an outer edge portion of the grounding conductor.

According to the on-board antenna constructed as described above, a radio wave which propagates on the surface of the dielectric substrate can be cut off and reflected by the conductive member.

Namely, when receiving radio waves, by cutting off radio waves which propagate on the surface of the dielectric substrate toward the conductive member, the receiving property, in particular, the sensitivity property according to a elevation angle can be set to a desired condition.

On the other hand, when sending radio waves, by reflecting those of radio waves radiated from the radiation element which propagate on the surface of the dielectric substrate toward the radiation element by the conductive member, the sending property, in particular, the sensitivity property according to a elevation angle can be set to a desired condition.

DETAILED DESCRIPTION OF THE PREFERRED EMBODIMENTS

Referring to the accompanying drawings, an embodiment of an on-board antenna of the present invention will be described below.

Figure 1:
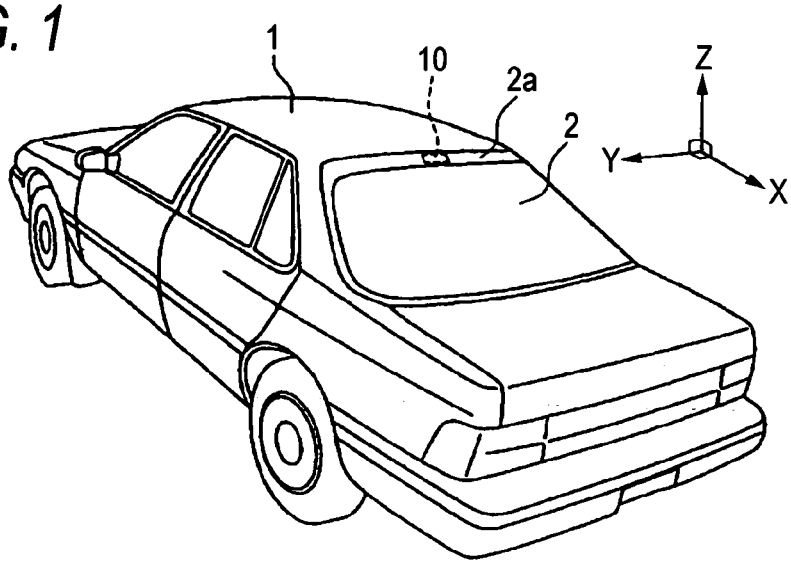
FIG. 1 is a perspective view of a vehicle on which an on-board antenna according to an embodiment of the present invention is installed.
Figure 2:
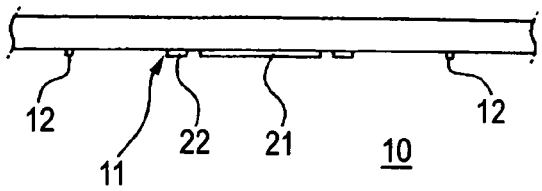
FIG. 2 is a cross-sectional view of the on-board antenna shown in FIG. 1.

An on-board antenna 10 according an embodiment of the present invention is, as shown in FIGS. 1 and 2, disposed on, for example, a passenger compartment-side inner surface 2A of a peripheral edge portion 2*a* of a rear window glass 2, for example, of window glasses of a vehicle 1.

Then, this on-board antenna 10 is may be, for example, a GPS antenna used in receiving a positioning signal from a GPS (Global Position System) communications network for measuring the position of a vehicle by making use of an artificial earth satellite or transmitting an emergency message by making use of positional information from GPS, for example, a DSRC (Dedicated Short Range Communications) antenna used in receiving data distributed from various types of information providing services or implementing a process of automatic toll collection through a narrow area radio communications DSRC between roadside radio equipment and on-board radio equipment, for example, an antenna for receiving data distributed from broadcasting and/or various types of information providing services which utilize an artificial earth satellite, or, for example, a mobile communications antenna used for mobile communications between an artificial earth satellite, or appropriate base station and the vehicle.

The on-board antenna 10 includes, for example, a planar antenna 11 disposed on the passenger compartment-side inner surface 2A of the rear window glass 2 which functions as a dielectric substrate and a pair of linear conductors 12, 12 provided on the passenger compartment-side inner surface 2A so as to hold the planar antenna 11 from both sides thereof.

Figure 3:
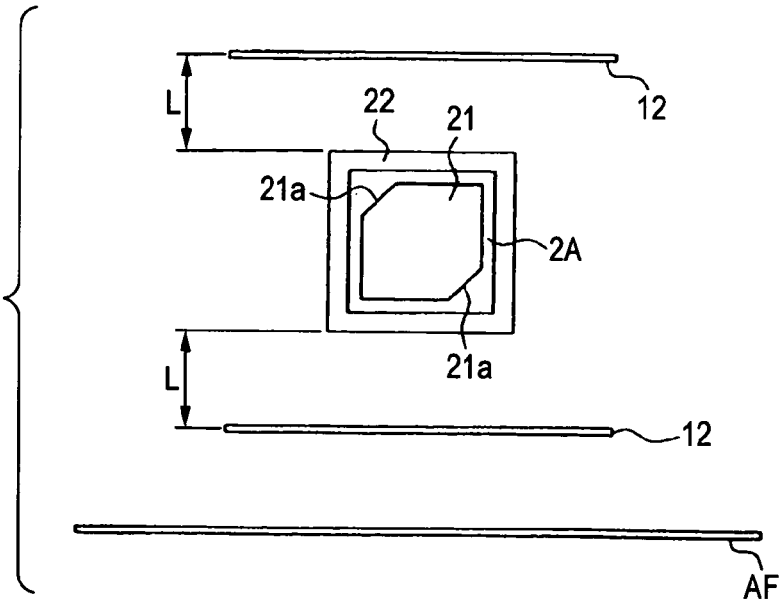
FIG. 3 is a plan view of the on-board antenna shown in FIG. 1.

The planar antenna 11 includes, for example, as shown in FIG. 3, a radiation element 21 comprising a conductive film and a grounding conductor 22 which are disposed on the passenger compartment-side inner surface 2A of the rear window glass 2.

The radiation element 21 is formed such that, in a substantially quadrangular conductive film having two pairs of two opposing sides, for example, a pair of two corner portions of two pairs of two opposing corner portions which are formed by two adjacent sides which intersect each other substantially at right angles is cut so as to form substantially linear perturbative portions 21*a*, 21*a*, so that a circularly polarized wave mode is generated by these perturbative portions 21*a*, 21*a*.

Then, the radiation element 21 is connected to an appropriate feeding line (not shown) so that an appropriate high-frequency electric current is fed thereto.

The grounding conductor 22 is, for example, formed into a substantially quadrangular annular conductive film and is connected to an appropriate ground wire (not shown) so as to be grounded at all times. The grounding conductor 22 is disposed so as to surround the periphery of an outer edge portion of the radiation element 21 provided on the passenger compartment-side inner surface 2A at a position spaced away outwardly from the outer edge portion.

According to this construction, the passenger compartment-side inner surface 2A of the rear window glass 2 which is made to function as the dielectric substrate is exposed between the outer edge portion of the radiation element 21 and an inner edge portion of the grounding conductor 22, and the planar antenna 11 is made to function as an antenna when a so-called resonance circuit is formed between the radiation element 21 and the grounding conductor 22.

Here, by setting the antenna properties of the planar antenna, for example, the resonant frequency and frequency band of a radio wave to be transmitted and received to desired values, the permittivity of the rear window glass 2 made to function as the dielectric substrate, respective lengths of the two pairs of opposing sides of the radiation element 21 and the distance between the outer edge portion of the radiation element 21 and the inner edge portion of the grounding conductor 22 are set to appropriate values.

The pair of linear conductors 12, 12 is formed longer than the respective lengths of two pairs of two opposing sides of the radiation conductor 21, for example, and is disposed so as to become parallel with an appropriate pair of two opposing sides of the radiation conductor 21, for example, while holding the planar antenna from the both sides thereof at positions spaced away a predetermined distance L from an outer edge portion of the planar antenna or an outer edge portion of the grounding conductor 22.

The predetermined length L is, as will be described later on, set to a half or one fourth of a wavelength λ according to the resonant frequency of, for example, a radio wave to be transmitted and received so that, of the transmitting and receiving properties of the planar antenna 11, for example, in particular, the sensitivity property according to a elevation angle becomes a desired condition.

In addition, in FIG. 3, a linear antenna AF for receiving radio waves having different frequency bands (for example, AM and FM bands) from those of the planar antenna 11 is provided on the passenger compartment-side inner surface 2A at a position spaced away an appropriate distance from the outer edge portion of the planar antenna 11. Then, one of the pair of linear conductors 12, 12 is disposed between the planar antenna 11 and the linear antenna AF.

The on-board antenna 10 according to the embodiment of the present invention is constructed as has been described heretofore, and the operation properties of the on-board antenna 10 will be described below by reference to the accompanying drawings.

With the on-board antenna 10, a radio wave which propagates on the surface of the rear window glass 2 which is made to function as a dielectric substrate can be cut off and reflected by the linear conductors 12.

Namely, when receiving radio waves, by cutting off radio waves which propagate on the surface of the rear window glass 2 toward the planar antenna 11, the receiving property, in particular, the sensitivity property according to a elevation angle can be set to a desired condition.

On the other hand, when sending radio waves, by reflecting those of radio waves radiated from the planar antenna 11 which propagate on the surface of the rear window glass 2 toward the planar antenna 11 by the linear conductors 12, the sending property, in particular, the sensitivity property according to a elevation angle can be set to a desired condition.

Figure 4:
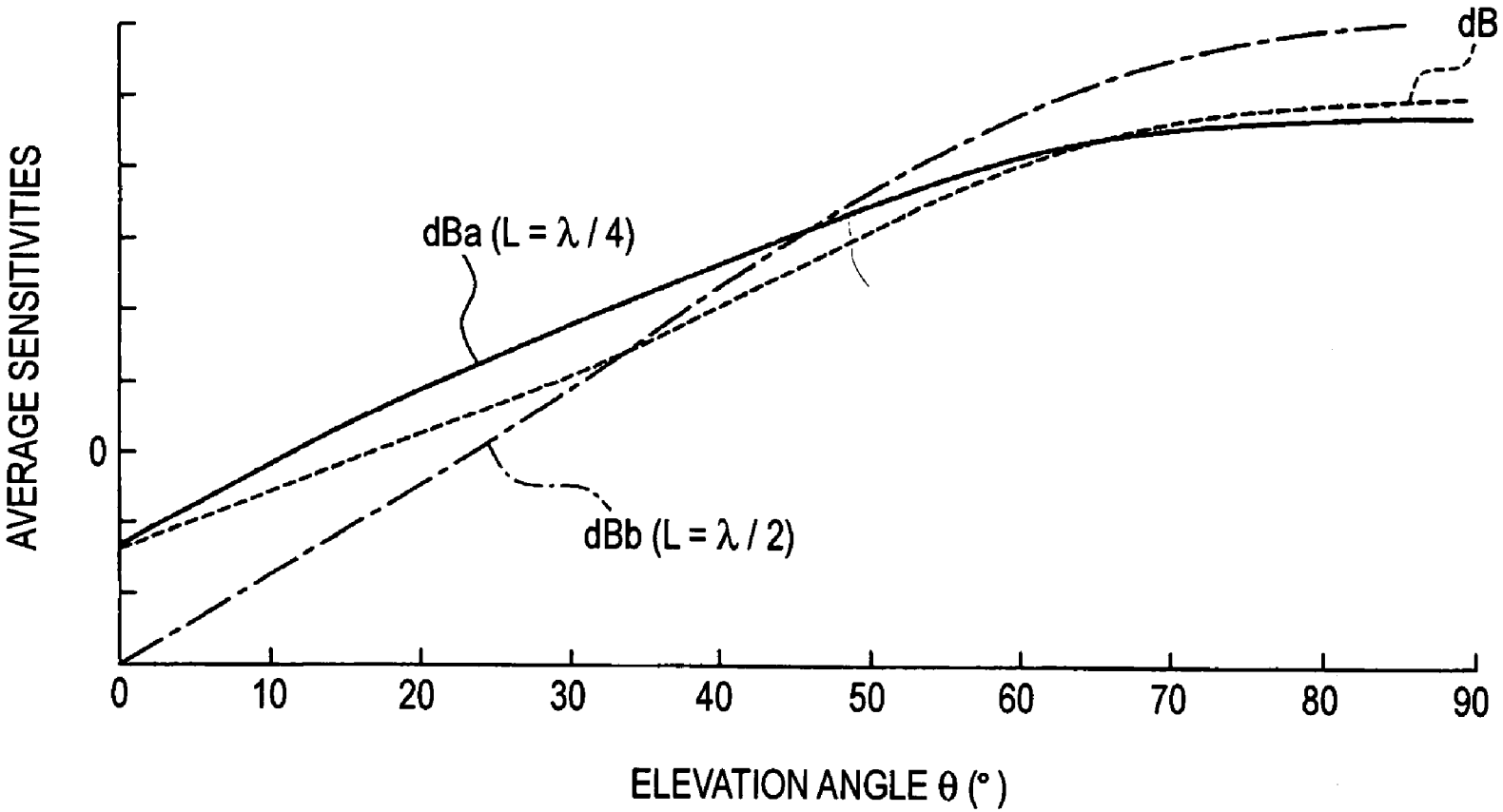
FIG. 4 is a graph illustrating examples of changes according to a elevation angle θ in average sensitivities resulting with the on-board antenna shown in FIG. 1, resulting from a case where a pair of linear conductors is omitted from the on-board antenna shown in FIG. 1, and resulting with an on-board antenna according to a second modified example made to the embodiment of the present invention.

As shown in FIG. 4, for example, in a case where the predetermined distance L from the outer edge portion of the grounding conductor 22 to the respective linear conductors 12 is set to a value which is one fourth the wavelength λ of a radio wave of a desired resonant frequency, it is recognized that a change according to a elevation angle θ in average value (average sensitivity) dBa around a vertical axis (a Z axis shown in FIG. 1) of a sensitivity or gain relative to a radio wave at a desired resonant frequency of the on-board antenna 10 becomes a larger value at a relatively low elevation angle than an average sensitivity dB resulting when the linear conductors 12 are omitted.

In addition, as will be described later on, in the event that the predetermined length L is set to, for example, a value which is a half the wavelength λ, it is recognized that an average sensitivity in a large value can be secured at a relatively high elevation angle than the average sensitivity dB resulting when the linear conductors 12 are omitted.

As has been described heretofore, according to the on-board antenna 10 according to the embodiment of the present invention, radio waves propagating on the surface of the rear window glass 2, which is made to function as the dielectric substrate can be cut off and reflected by the linear conductors 12, whereby the transmitting and receiving properties of the on-board antenna 10, in particular, the sensitivity properties thereof according to elevation angles can be improved to a desired condition, and additionally, even in the event that there exists another antenna, the interference action between the antennas can be reduced.

Figure 5:
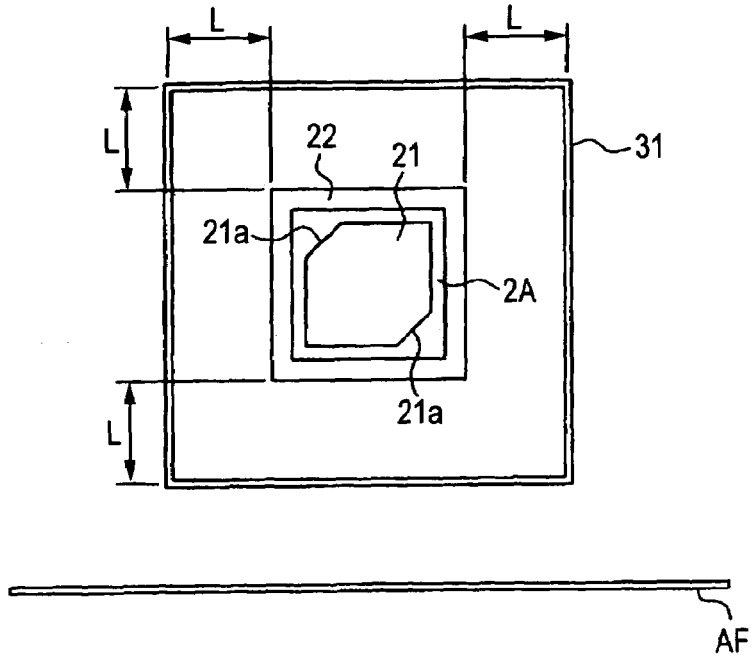
FIG. 5 is a plan view of an on-board antenna according to a first modified example to the embodiment.

Note that while, in the embodiment of the present invention, the pair of linear conductors 12, 12 are disposed in such a manner as to hold the planar antenna 11 from the both sides thereof, the present invention is not limited thereto, and for example, as with an on-board antenna 10 according to a first modified example shown in FIG. 5, for example, an annular conductor 31 may be disposed in such a manner as to surround the periphery of an outer edge portion of a planar antenna 11 or an outer edge portion of a grounding conductor 22 at a position spaced away by a distance L of the outer edge portion.

Figure 6:
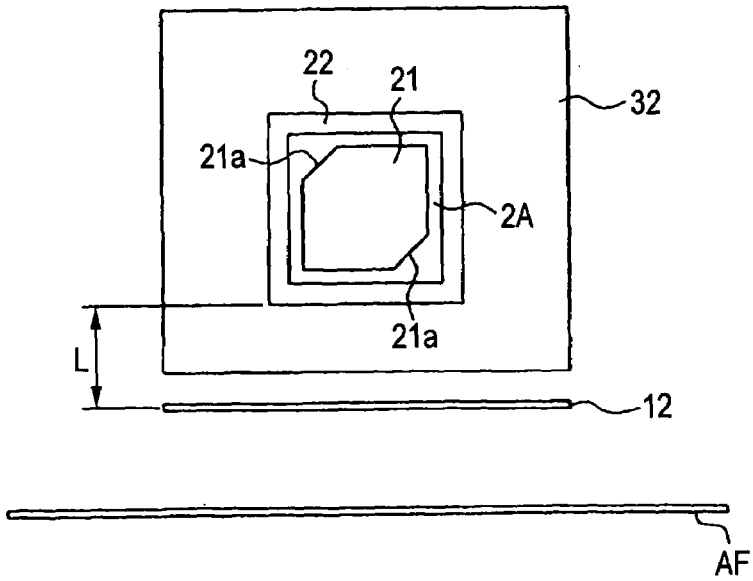
FIG. 6 is a plan view of an on-board antenna according to the second modified example to the embodiment.

In addition, for example, as with an on-board antenna 10 according to a second modified example shown in FIG. 6, the other linear conductor 12 of the pair of the linear conductors 12, 12 in the embodiment maybe omitted and instead, a film-like conductor 32 may be provided so as to extend outwardly from an outer edge portion of a grounding conductor 22 of a planar antenna 11 on a passenger compartment-side inner surface 2A.

In this second modified example, an average sensitivity dBb resulting when a predetermined distance L from the outer edge portion of the grounding conductor 22 to the linear conductor 12 is set to a value which is one half the wavelength λ of a radio wave at a desired resonant frequency is, as shown in FIG. 4, for example, suppressed to a smaller value at a relatively small elevation angle, and a larger value can be secured at a relatively high elevation angle.

Thus, the elevation angle property of the on-board antenna 10 can be set appropriately in accordance with radio waves to be transmitted and received.

Note that while, in the embodiment of the present invention, the planar antenna 11 is made to include the radiation conductor 21 which is formed of the conductive film and the grounding conductor 22, the present invention is not limited thereto. For example, a radiation element formed of a semiconductor may be provided in place of the radiation conductor 21.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

As has been described heretofore, according to the on-board antenna as set forth in the first aspect of the present invention, radio waves propagating on the surface of the dielectric substrate can be cut off and reflected by the conductive members, whereby the transmitting and receiving properties of the on-board antenna, in particular, the sensitivity properties according to elevation angles can be improved to a desired condition.

What is claimed is:

1. An on-board antenna comprising:

a radiation element provided on a dielectric substrate;

a grounding conductor provided on the dielectric substrate and surrounding a periphery of an outer edge portion of the radiation element at a position spaced away outwardly from the outer edge portion; and a conductive member provided on the dielectric substrate at a position spaced away outwardly from an outer edge portion of the grounding conductor, wherein the radiation element, the grounding conductor, and the conductive member are provided on the same surface of the dielectric substrate.

2. An on-board antenna as set forth in claim 1, wherein the conductive member surrounds the periphery of the edge portion of the grounding conductor at a position spaced away outwardly from the outer edge portion.

3. An on-board antenna as set forth in claim 2, wherein the conductive member is circular-shape.

4. An on-board antenna as set forth in claim 1, wherein the conductive member is film.

5. An on-board antenna as set forth in claim 1, further comprising:

a linear antenna provided at a position spaced away from the conductive member and at the opposite side of the grounding conductor.

6. An on-board antenna comprising:

a radiation element provided on a dielectric substrate;

a grounding conductor provided on the dielectric substrate and surrounding a periphery of an outer edge portion of the radiation element at a position spaced away outwardly from the outer edge portion; and a pair of conductive members provided on the dielectric substrate at a position spaced away outwardly from an outer edge portion of the grounding conductor so as to oppose each other, wherein the radiation element, the grounding conductor, and the pair of conductive member are provided on the same surface of the dielectric substrate.

7. An on-board antenna as set forth in claim 1, wherein the conductive member is linear in shape.

8. An on-board antenna comprising:

a radiation element provided on a dielectric substrate;

a grounding conductor provided on the dielectric substrate and surrounding a periphery of an outer edge portion of the radiation element at a position spaced away outwardly from the outer edge portion; and a conductive member provided on the dielectric substrate at a position spaced away outwardly from an outer edge portion of the grounding conductor, wherein the radiation element, the grounding conductor, and the conductive member are provided directly on the dielectric substrate on the same surface thereof.

* * * * *